US006116477A

United States Patent [19]

Kreiseder et al.

[11] Patent Number: 6,116,477

[45] Date of Patent: Sep. 12, 2000

[54] TWO PIECE HINGE CLOSURE

[75] Inventors: Walter J. Kreiseder, Barrington; Thomas C. Stoneberg, Buffalo Grove; Gary Berge, Crystal Lake, all of Ill.

[73] Assignee: Courtesy Corporation, Buffalo Grove, Ill.

[21] Appl. No.: 09/459,820

[22] Filed: Dec. 13, 1999

[51] Int. Cl.[7] ..... B65D 47/00

[52] U.S. Cl. ..... 222/556; 222/546

[58] Field of Search ..... 222/556, 568, 222/543, 547, 546; 220/259, 375; 215/235, 330

[56] References Cited

U.S. PATENT DOCUMENTS

| | | |
|---|---|---|
| 3,124,281 | 3/1964 | Stull . |
| 3,278,089 | 10/1966 | Heekin et al. . |
| 4,377,247 | 3/1983 | Hazard et al. . |
| 4,377,248 | 3/1983 | Stull . |
| 4,534,483 | 8/1985 | Kassis et al. . |
| 4,615,462 | 10/1986 | Sacherer et al. . |
| 5,067,624 | 11/1991 | Thanisch . |
| 5,069,367 | 12/1991 | Salmon et al. . |
| 5,219,100 | 6/1993 | Beck et al. . |
| 5,513,768 | 5/1996 | Smith . |
| 5,593,054 | 1/1997 | Glynn . |
| 5,967,384 | 10/1999 | Mengeu et al. . |
| 5,992,659 | 11/1999 | Nofer et al. ..... 222/556 |

*Primary Examiner*—Philippe Derakshani
*Assistant Examiner*—Thach Bui
*Attorney, Agent, or Firm*—Silverman, Cass & Singer, Ltd.

[57] ABSTRACT

A two piece hinge closure including a base and a separately formed cap. The cap includes an attachment ring and a hinge connecting the cap to the ring. The base has an upstanding spout surrounded by a circular channel formed in the base. The ring is adapted to be secured in the channel to hold the cap securely on the base, with the cap being pivotal with respect to the base about the hinge connected to the ring.

7 Claims, 4 Drawing Sheets

FIG. 1
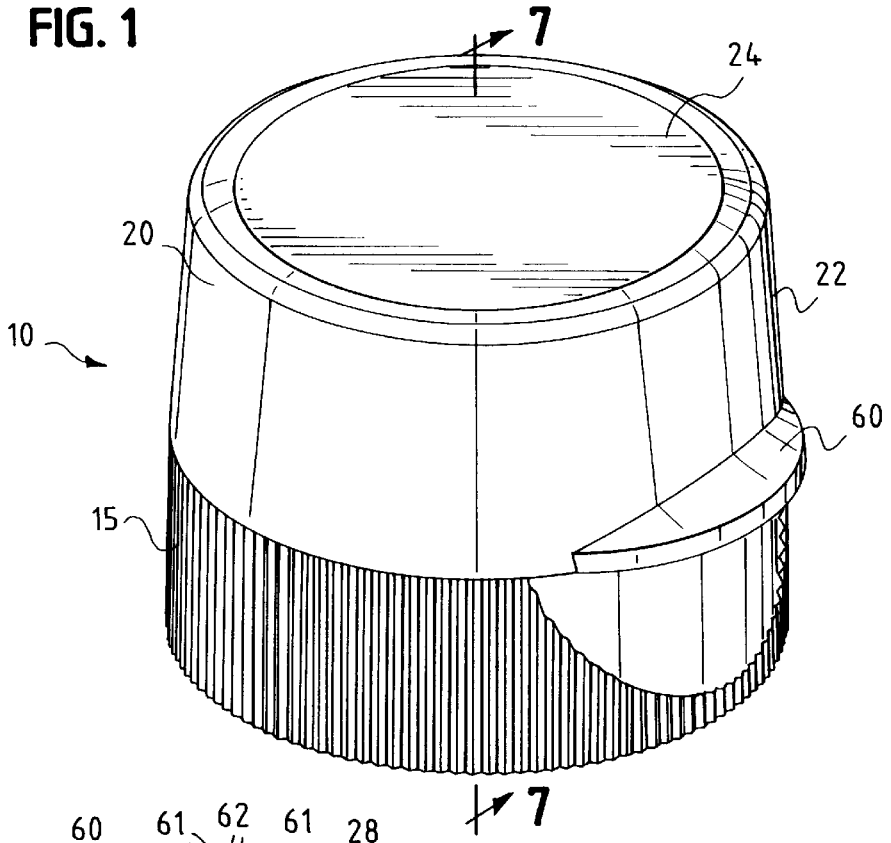
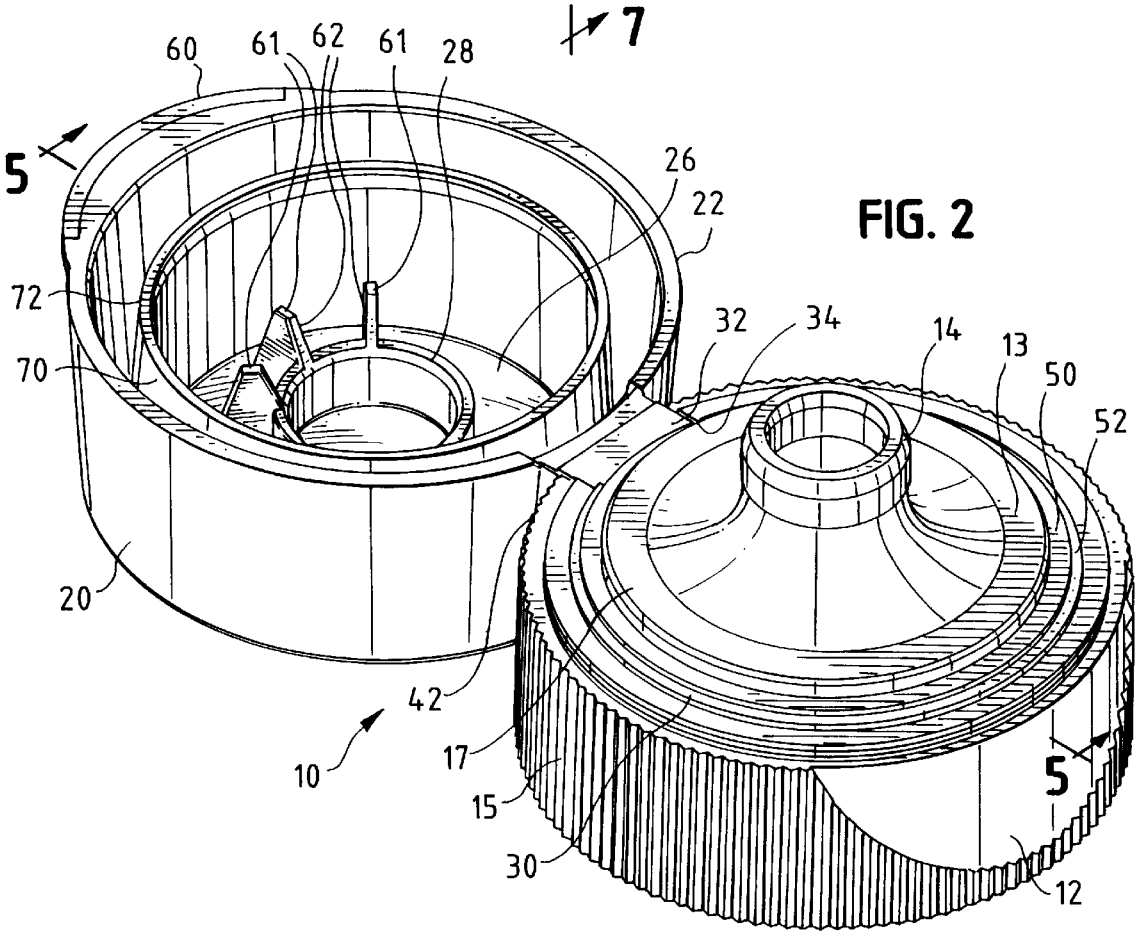
FIG. 2

TWO PIECE HINGE CLOSURE

BACKGROUND OF THE INVENTION

1. Field of the Invention

This invention relates generally to dispensing closures for containers, and more particularly, to such closures including a base portion and a separate hinge cap portion cooperatively engageable upon said base portion.

2. Description of the Prior Art

Two piece closures for containers are known and generally include a base portion adapted to be positioned on the mouth of the container and a separately formed cap portion which is cooperatively engageable upon said base to complete the closure. Formation of such closures from separate cap and base pieces is desirable and advantageous because, where such closures are formed of molded plastic material, the two pieces may be produced using molds which are less complicated and expensive that molds required for forming one piece closures, and also, the two separate pieces may be molded from different color plastic material.

It also is known to provide closures having a base and cap portion connected by a hinge such that the cap is pivotal with respect to the base from an open position in which the cap is displaced from the base to a closed position in which the cap is pivoted about the hinge to a closed position with the cap engaged over the base.

In instances where a two piece closure is desired to be provided with a hinge connection between the cap and the base, it is necessary to include structure associated with the cap which is engageable upon the base to provide a connection between the cap and the base with the hinge therebetween so that the cap is operable with respect to the base between an open and closed position as intended by such closures. The structure associated with the cap and engageable upon the base preferably may be formed easily by injection molding process such as that used for molding plastic material parts, and is readily assemblable between the cap and the base to provide the desired two piece hinge closure for use with containers.

SUMMARY OF THE INVENTION

The invention is characterized by a two piece hinge closure including a base portion and a separately formed cap portion. The cap potion includes an attachment ring formed integrally with the cap and having a hinge connecting the cap to the ring. The base portion is adapted to be secured to the mouth of a container and includes a spout surrounded by a circular channel formed in the base. The ring of the cap is matingly engageable within the channel formed on the base to hold the cap securely upon the base when the cap is assembled therewith. The so assembled cap and base forms the two piece hinge closure of the invention in which the cap is movable between open and closed positions by pivoting the cap with respect to the base about the hinge connected between the base-mounted ring and the cap.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages of the invention.

BRIEF DESCRIPTION OF THE DRAWINGS

FIG. 1 is a perspective view of the two piece hinge closure of the invention, in which the cap is shown in its closed position with respect to the base;

FIG. 2 is a perspective view of the closure shown in FIG. 1, with the cap moved to its open position with respect to the base;

DESCRIPTION OF THE PREFERRED EMBODIMENT

Figure 3:
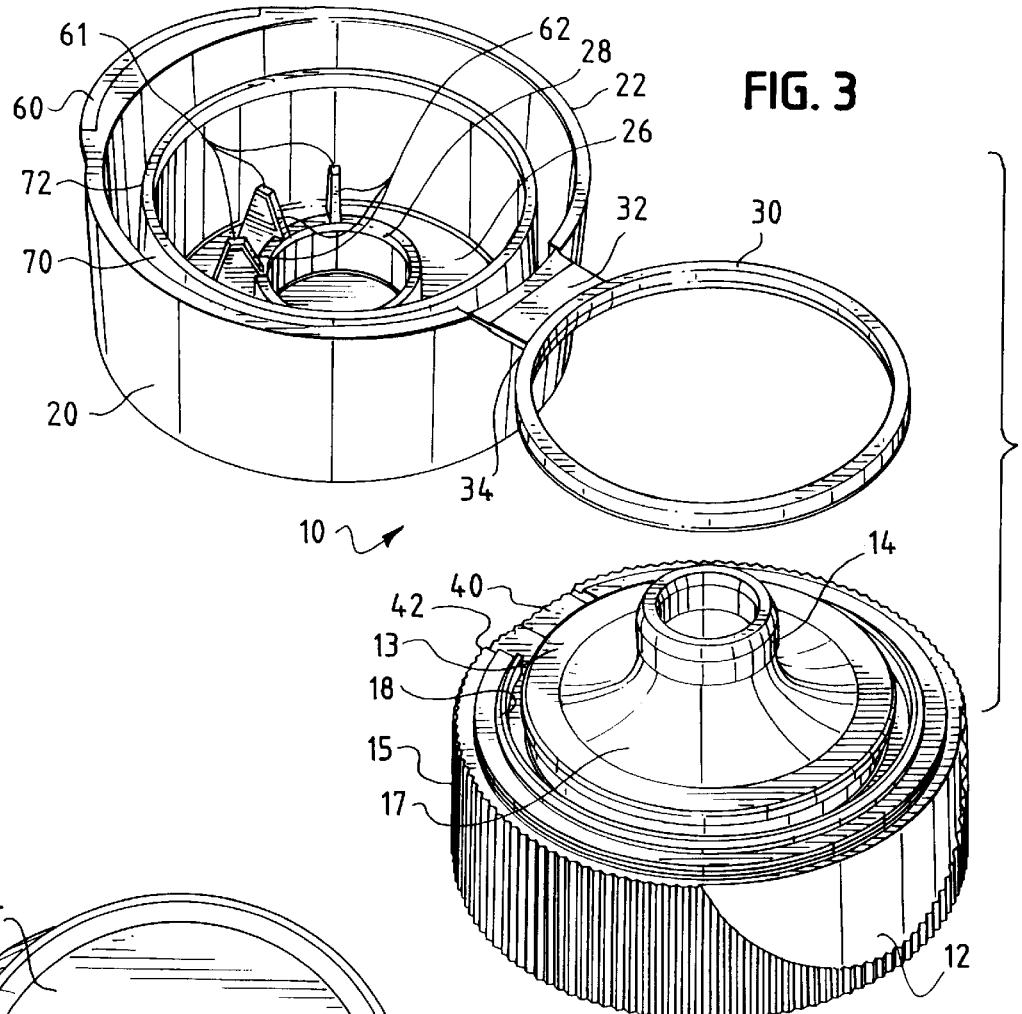
FIG. 3 is an exploded perspective view showing the cap and associated attachment ring separated from the base.
Figure 4:
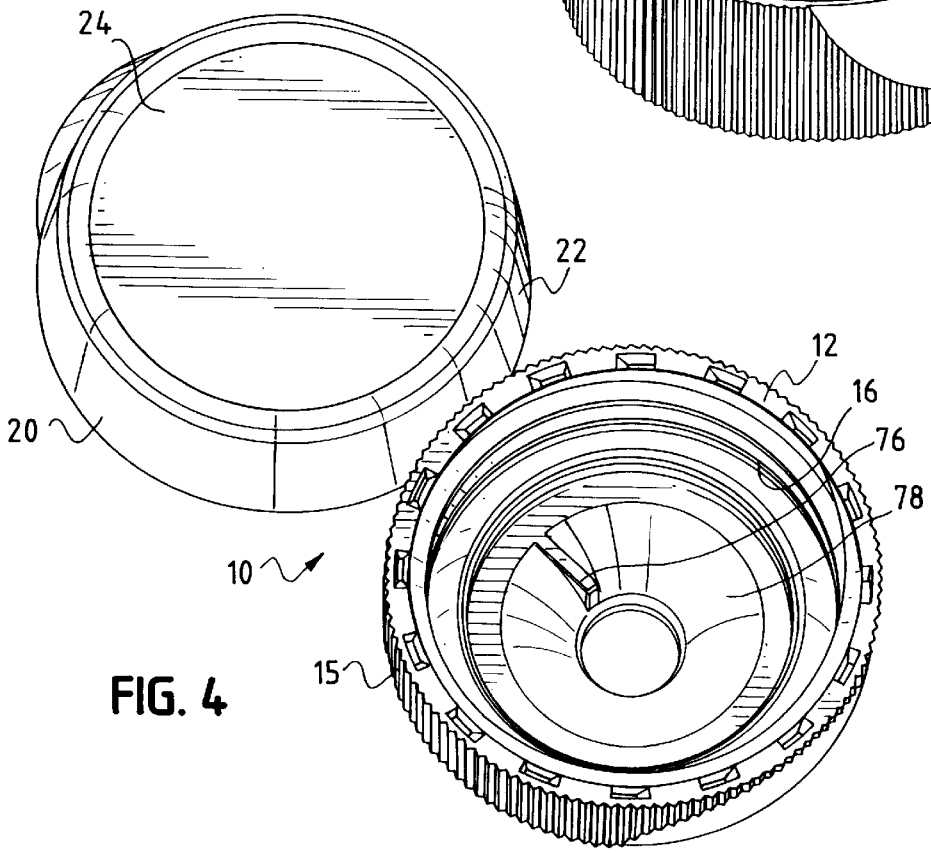
FIG. 4 is a perspective view of the closure of the invention with the cap disposed in its open position with respect to the base, and the underside portions of the base being illustrated.
Figure 5:
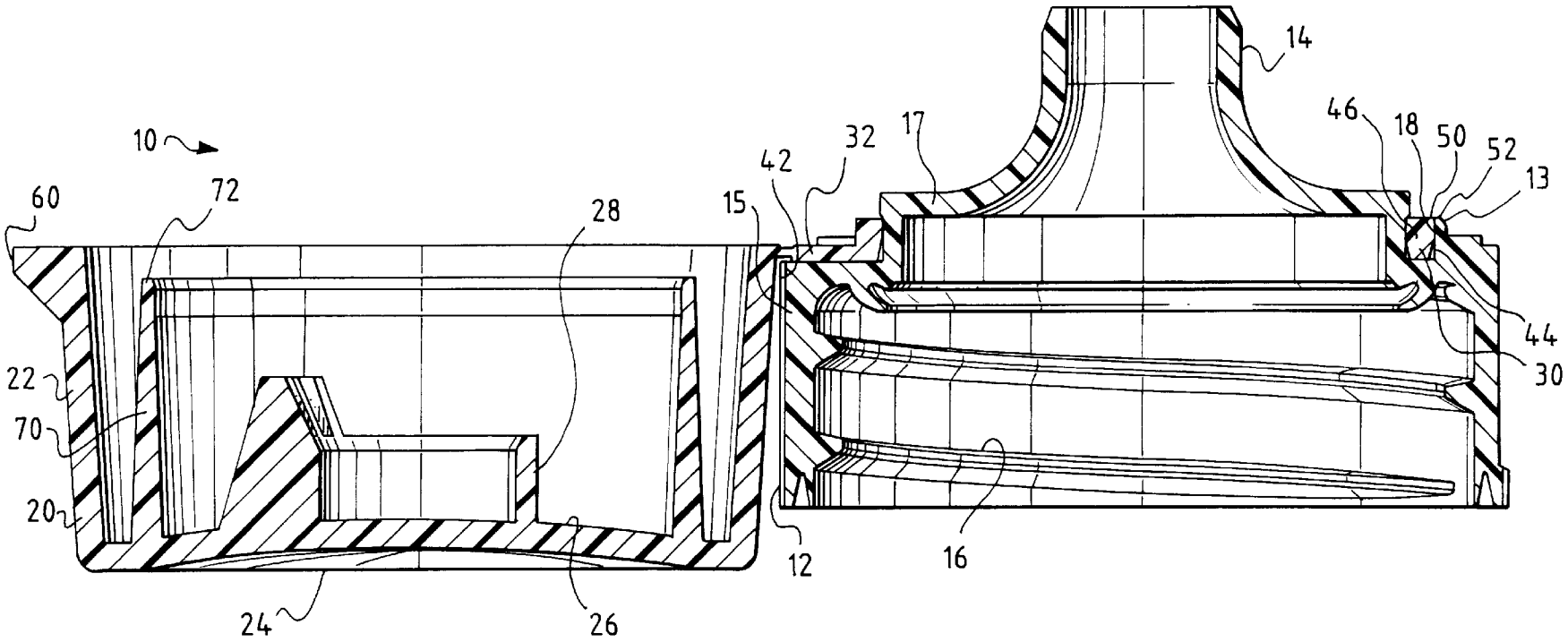
FIG. 5 is a sectional view taken along the line 5—5 of FIG. 2, in the direction indicated generally.

Referring to the drawings, the two piece hinge closure 10 of the invention preferably is formed of molded plastic material and includes a base 12 with an upstanding spout 14 formed integral with the base 12. The base 12 is adapted for attachment to a container mouth (not shown) in known manner, such as by screw threads 16 formed on the inner surface of the base 12 which mate with like threads on the mouth of the container.

Base 12 includes a cylindrical body part 15 with a top wall portion 13 upon the top side 17 of which is formed spout 14. A circular channel 18 is formed in top wall 13 and surrounds spout 14.

Cap 20 is molded separately from base 12 and is provided for cooperative engagement by assembly with base 12 to from the closure 10. Cap 20 includes a cylindrical wall 22 with a closing top wall 24 to close off the cylindrical wall 22. The underside 26 of wall 24 is formed with a depending plug 28, adapted for cooperative engagement with spout 14 to close same when the cap is engaged over base 12 as described hereinbelow.

Circular attachment ring 30 is formed integrally with cap 20 and is connected thereto by hinge 32. Hinge 32 extends between an edge part 34 of ring 30 and cylindrical wall 22 of cap 20.

Separately molded cap 20 and base 12 are assembled together to form closure 10 by inserting ring 30 of cap 20 within channel 18 of base 12. Channel 18 is formed with a detent 40 (see FIG. 3) which passes radially along top wall 17 to the edge 42 of body part 15 to receive hinge 32 and hold same in position and prevent movement thereof when the ring 30 is inserted into channel 18. A barb 44 is formed on ring 30 to engage against the wall 46 of channel 18 and effect an interference fit when the ring is inserted therein, thereby to prevent removal of the ring from the channel after the ring is assembled therein. The top surface 50 of ring 30 is positioned flush with the top surface 52 of base top wall 13 when ring 30 is positioned in channel 18 to prevent collection of dirt or other undesirable matter in the channel 18.

Figure 6:
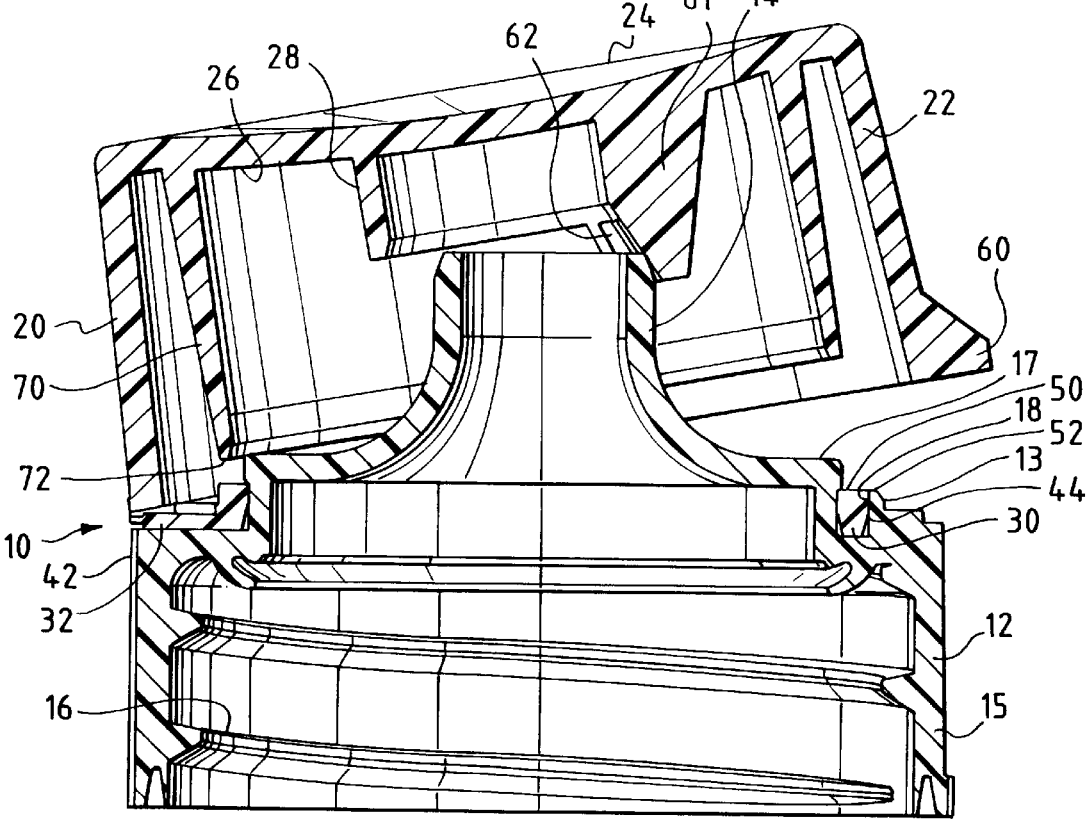
FIG. 6 is a sectional view taken through the closure of the invention showing the cap moved to partially closed position with respect to the base.
Figure 7:
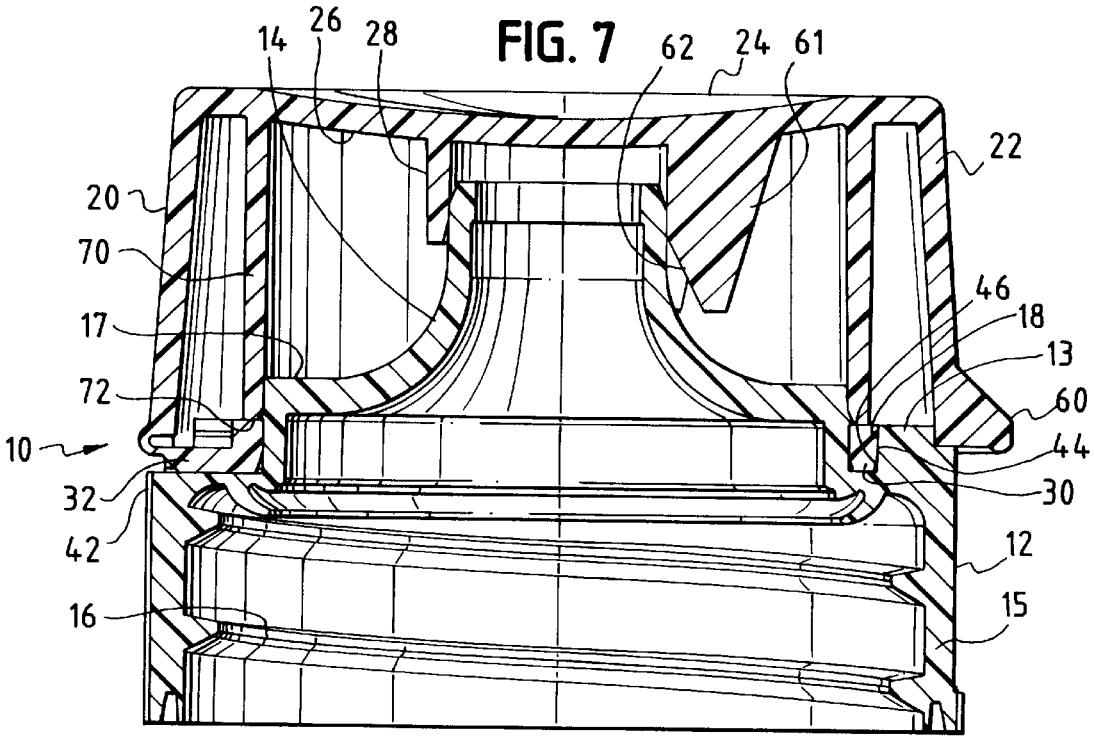
FIG. 7 is a sectional view taken along the line 7—7 of FIG. 1, in the direction indicated generally.

When cap 20 is assembled upon base 12 by insertion of ring 30 within channel 18, the cap is movable between its open position seen in FIGS. 2–5 and the closed position seen in FIGS. 1 and 7 by pivoting the cap about hinge 32 so that cap 20 covers base 12 with plug 28 engaged over spout 14. A protruding lip 60 is formed on cap 20 to facilitate opening by a user when the cap is in its closed position. Plug 28 has formed along the outer circumferential edge thereof depending guide ribs 61 with canted edges 62 which engage against spout 14 when the cap is moved to closed position over base 12 (see FIG. 6). The guide ribs 61 direct the plug 28 to properly engage spout 14 and thereby prevent damage to the spout when the plug is so engaged thereover.

Cap 20 can be assembled upon base 12 in either the open or closed position. An inner seal flange 70 is formed on the underside 26 of top wall 24 of cap 20 and extends circumferentially thereabout at a location which is in registry with ring 30 when cap 20 is disposed in closed position with respect to base 12. Thereby, if cap 20 is assembled upon base 12 in closed position, the free edge 72 of seal flange 70 engages against ring 30 to push the same into channel 18 and effect assembly of the closure.

If it is desired to assemble the base and cap in open position, a tool (not shown) will be used to push the ring 30 into channel 18. In order to facilitate such assembly, keying rib 76 (FIG. 4) is formed on the underside 78 of base 12 to indicate the location of detent 40 which passes radially along top wall 17 to the edge 42 of body part 15 into which hinge 32 is to be positioned when cap 20 is assembled on base 12.

In the preferred embodiment illustrated in the drawings, hinge 32 is a living hinge, but the structure of the invention is usable with other types of hinges. The separately-molded feature of the cap and base permits the two parts to be different colors, and the molding process is less complicated and expensive than hinge caps that are molded together with their associated base.

Other configurations and variations in the structure, arrangement and size of the various parts may occur to those skilled in the art without department from the spirit or circumventing the scope of the invention as set forth in the appended claims.

What is claimed is:

1. A closure for a container having a mouth, said closure comprising, a base adapted for positioning on said mouth, the base including a cylindrical body part with a top wall, a spout formed in said top wall to permit dispensing of contents from said container, a circular channel formed in said top wall and surrounding said spout, a cap formed separately from said base, the cap including a cylindrical wall and a closing wall closing one end of said cylindrical wall, a circular attachment ring formed integrally with said cap, a hinge connecting said circular attachment ring to said cylindrical wall of said cap, said attachment ring being positioned within said channel to retain the cap and base together, whereby the cap is movable with respect to the base between open and closed positions by pivoting the cap about the hinge.

2. A closure as claimed in claim 1 in which the closing wall has an inside surface facing the base when the cap is moved to said closed position, a plug formed on said inside surface, the plug adapted for cooperative engagement with the spout to close same when the cap is moved to said closed position.

3. A closure as claimed in claim 2 including at least one guide rib formed adjacent to said plug to engage against said spout and guide the plug into engagement with the spout when the cap is moved to said closed position.

4. A closure as claimed in claim 1 in which said channel is formed with a detent passing radially along said top wall to the edge of said cylindrical body part, said hinge being disposed within said detent and held thereby in position when said ring is located within said channel.

5. A closure as claimed in claim 1 in which a barb is formed on said ring to engage against the wall of said channel and prevent removal of the ring from the channel.

6. A closure as claimed in claim 1 in which the closing wall has an inside surface facing the base when the cap is in said closed position, a seal flange formed on said inside surface concentric with said cylindrical wall of the cap, said seal flange being in registry with said attachment ring to engage the ring and apply pressure thereagainst into said channel.

7. A closure as claimed in claim 4 in which said base has a keying rib formed on the side of the top wall which faces the container, said keying rib being aligned with said detent to facilitate positioning of said attachment ring within said channel.

* * * * *

US006116477C1

(12) INTER PARTES REEXAMINATION CERTIFICATE (0012th)

United States Patent

Kreiseder et al.

(10) Number: US 6,116,477 C1

(45) Certificate Issued: Dec. 25, 2007

(54) TWO PIECE HINGE CLOSURE

(75) Inventors: Walter J. Kreiseder, Barrington, IL (US); Thomas C. Stoneberg, Buffalo Grove, IL (US); Gary Berge, Crystal Lake, IL (US)

(73) Assignee: Creative Packaging Corp., Buffalo Grove, IL (US)

Reexamination Request:
No. 95/000,111, Sep. 16, 2005

Reexamination Certificate for:

| | |
|---|---|
| Patent No.: | **6,116,477** |
| Issued: | **Sep. 12, 2000** |
| Appl. No.: | **09/459,820** |
| Filed: | **Dec. 13, 1999** |

(51) Int. Cl.
*B65D 47/00* (2006.01)
*B67D 3/00* (2006.01)

(52) U.S. Cl. ..... 222/556; 222/546

(58) Field of Classification Search ..... None
See application file for complete search history.

(56) References Cited

U.S. PATENT DOCUMENTS

| | | | | |
|---|---|---|---|---|
| 3,124,281 A | | 3/1964 | Stull | |
| 3,240,405 A | * | 3/1966 | Abbott | 222/543 |
| 5,067,624 A | | 11/1991 | Thanisch | |
| 5,386,918 A | | 2/1995 | Neveras et al. | |
| 5,437,383 A | | 8/1995 | Stull | |
| 5,642,824 A | | 7/1997 | Hess, III et al. | |
| 5,785,193 A | | 7/1998 | Kobayashi et al. | |
| 6,116,477 A | | 9/2000 | Kreiseder et al. | |

FOREIGN PATENT DOCUMENTS

| | | |
|---|---|---|
| ES | 1 002 990 | 7/1988 |

OTHER PUBLICATIONS

Webster's New World Dictionary of American English, Third College Edition, p. 165 Bouncy/bow, Copyright 1988 by Simon & Schuster, Inc.*

* cited by examiner

*Primary Examiner*—Jeanne M Clark

(57) ABSTRACT

A two piece hinge closure including a base and a separately formed cap. The cap includes an attachment ring and a hinge connecting the cap to the ring. The base has an upstanding spout surrounded by a circular channel formed in the base. The ring is adapted to be secured in the channel to hold the cap securely on the base, with the cap being pivotal with respect to the base about the hinge connected to the ring.

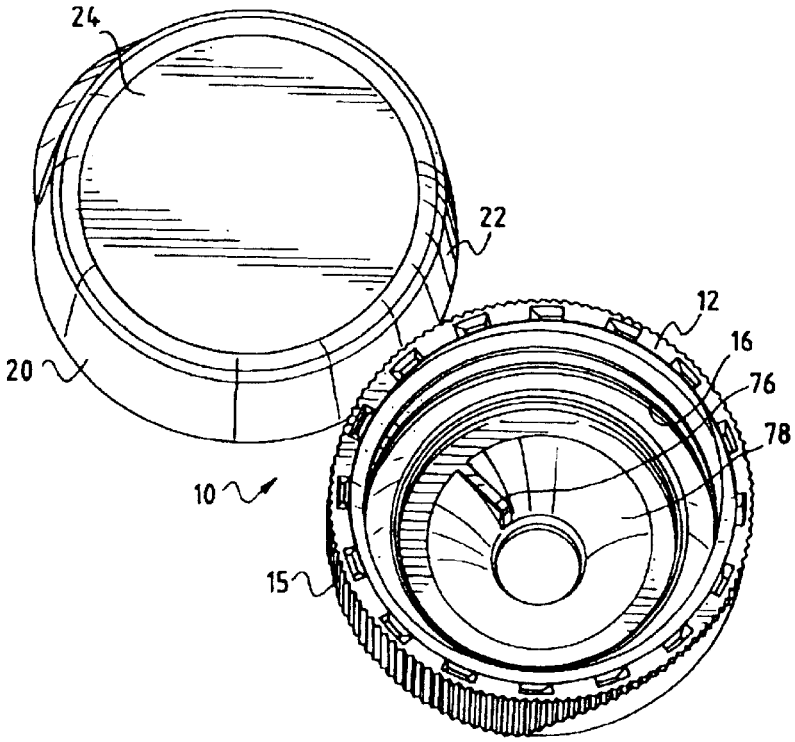

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3, 4, 6 and 7 is confirmed.

Claims 1, 2 and 5 are cancelled.

* * * * *